US005423449A

United States Patent [19]

Gordon et al.

[11] Patent Number: 5,423,449

[45] Date of Patent: Jun. 13, 1995

[54] MULTI-COMPARTMENT OVENABLE FOOD CONTAINER

[75] Inventors: Robert L. Gordon, Monroe; Kurt D. Jensen, Walden; Paul D. Roosa, Saugerties, all of N.Y.

[73] Assignee: International Paper Company, Purchase, N.Y.

[21] Appl. No.: 143,714

[22] Filed: Nov. 1, 1993

[51] Int. Cl.[6] ..... B65D 90/04

[52] U.S. Cl. ..... 220/410; 206/557; 229/169

[58] Field of Search ..... 229/208, 229, 231, 232, 229/40, 169, 207; 206/557; 220/410

[56] References Cited

U.S. PATENT DOCUMENTS

| | | | |
|---|---|---|---|
| 2,703,287 | 3/1955 | Peters . | |
| 2,745,752 | 5/1956 | Peters . | |
| 2,973,086 | 2/1961 | Thompson | 229/232 X |
| 3,069,043 | 12/1962 | Bishop . | |
| 3,271,169 | 9/1966 | Baker . | |
| 3,281,051 | 10/1966 | O'Brien . | |
| 3,286,909 | 11/1966 | Scharre . | |
| 3,349,985 | 10/1967 | Salway | 206/557 |
| 3,394,869 | 7/1968 | Fontana . | |
| 3,866,820 | 2/1975 | Zumsteg . | |
| 3,874,548 | 4/1975 | Buff . | |
| 3,899,079 | 8/1975 | Seiter . | |
| 3,918,608 | 11/1975 | Faller | 206/557 X |
| 3,938,730 | 2/1976 | Detzel . | |
| 4,043,503 | 8/1977 | Meyers et al. | 229/232 X |
| 4,202,465 | 5/1980 | McLaren . | |
| 4,221,320 | 9/1980 | Faller | 229/40 X |
| 4,257,530 | 3/1981 | Faller | 229/169 X |
| 4,529,089 | 7/1985 | Gasbarra . | |
| 4,661,671 | 4/1987 | Maroszek . | |
| 4,674,633 | 6/1987 | Steadman | 206/557 X |
| 4,687,104 | 8/1987 | Ielmini | 229/232 X |
| 4,801,017 | 1/1989 | Artusi | 220/410 X |
| 4,821,884 | 4/1989 | Griffin . | |
| 4,919,785 | 4/1990 | Willey et al. | 229/207 |
| 4,925,035 | 5/1990 | Hunninghaus . | |
| 4,994,638 | 2/1991 | Iorns . | |
| 5,078,273 | 1/1992 | Kuchenbecker | 229/207 |
| 5,090,615 | 2/1992 | Hopkins . | |
| 5,121,876 | 6/1992 | Johnson | 229/169 |

*Primary Examiner*—Allan N. Shoap
*Assistant Examiner*—Christopher T. McDonald
*Attorney, Agent, or Firm*—Paul R. Juhasz

[57] ABSTRACT

A package particularly useful for either conventional oven or microwave heating of refrigerated or frozen foodstuffs includes a lower paperboard tray, an upper frangible paperboard cover, and an intermediate compartmentalized plastic food tray. The bottom of the plastic tray food compartments rest on the tray bottom. The plastic tray side edges are clamped between laterally extending side flanges on the lower tray and edges of the top cover. The top cover is removed by ripping along tear lines. After consumption of the food, the plastic tray is readily removed to thereby facilitate separation for recycling. The package construction also facilitates the use of relatively thin plastic for forming the compartmentalized plastic tray because the weight of the foodstuffs in the plastic tray components is partially borne by the lower tray. In an embodiment, the plastic tray is inserted into the either end of a paperboard rectangular sleeve or tube and the tube ends closed, with only the two ends of the plastic tray supported by the paperboard lower tray portion.

5 Claims, 8 Drawing Sheets

MULTI-COMPARTMENT OVENABLE FOOD CONTAINER

BACKGROUND OF THE INVENTION

This invention relates to a plural-compartment ovenable food container particularly adaptable for storing food items in a refrigerated or frozen condition until ready for heating and consumption by the user.

Food containing trays, typically of plastic, for a complete dinner are often packaged in refrigerated or frozen form in paperboard cartons. Consumers conventionally need only to remove the food containing tray from an outer paperboard carton, peel off a sealed membrane, and then heat the tray and food therein prior to consumption. Constructions of this type employ a relatively thick plastic tray since the tray must support itself in the oven, and must be of sufficient strength to prevent its collapse when carried into and removed from the oven and otherwise handled after removal from the carton. The plastic tray typically has a plurality of compartments for holding different foods, such as an entree, vegetables, and a dessert.

SUMMARY OF THE INVENTION

According to the practice of this invention, a tray having a plurality of food receiving compartments is fashioned of relatively thin plastic and placed in a lower paperboard tray. An upper paperboard top closure cover is glued along its longitudinal edges to horizontally extending flanges on the lower paperboard tray. The longitudinal edges of the plastic tray are clamped between edges of the top paperboard cover and flanges of the lower paperboard tray. Similarly, the end or transverse edges of the plastic tray are clamped between the top cover and end transverse flanges of the lower paperboard tray. The bottoms of the compartments in the plastic tray rest against the bottom of the lower paperboard tray. By virtue of this construction, the tendency of the plastic tray to flex and bend when picked up is resisted by both the rigidity of the plastic tray and the rigidity of the lower tray, thereby reducing the requirement of strength and hence greater thickness of the plastic tray. This permits economies to be realized by the use of less plastic. The lower paperboard tray is used to support the plastic tray during distribution, heating, and food consumption. Further, the plastic tray is positioned relative to the lower tray and the top cover only by a clamping action, and not by glue or adhesive bonding. This permits relatively easy separation of the plastic tray from the paperboard bottom tray after the foodstuff has been consumed. This is an important feature in recycling.

DETAILED DESCRIPTION OF THE INVENTION

Figure 1:
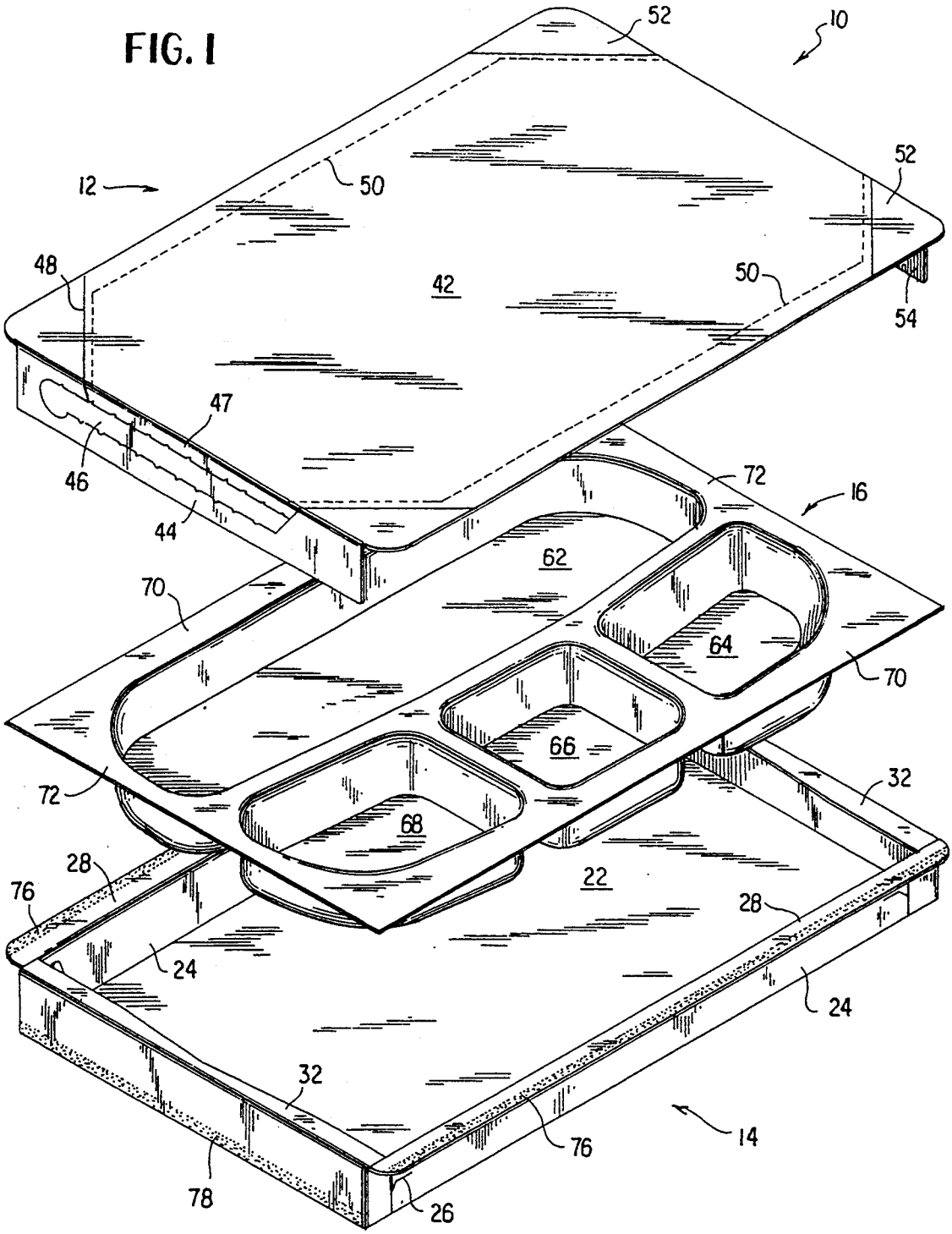
FIG. 1 is an exploded view illustrating the three components of the container of this invention.

Referring now to FIG. 1 of the drawings, the container 10 of this invention is shown in exploded form and includes a top cover 12 fashioned from a unitary blank of paperboard. A lower tray 14 of generally rectangular parallelepiped form, also fashioned from a unitary blank of paperboard or other stiff, foldable and bendable sheet material, is provided with laterally extending flanges. The middle element of the assembly is designated as 16 and is defined by a plastic multi-compartment tray having a plurality of individual food receiving compartments 62, 64, 66, and 68 having walls, together with longitudinally extending edge, 70 and transversely extending end edges 72.

Figure 2:
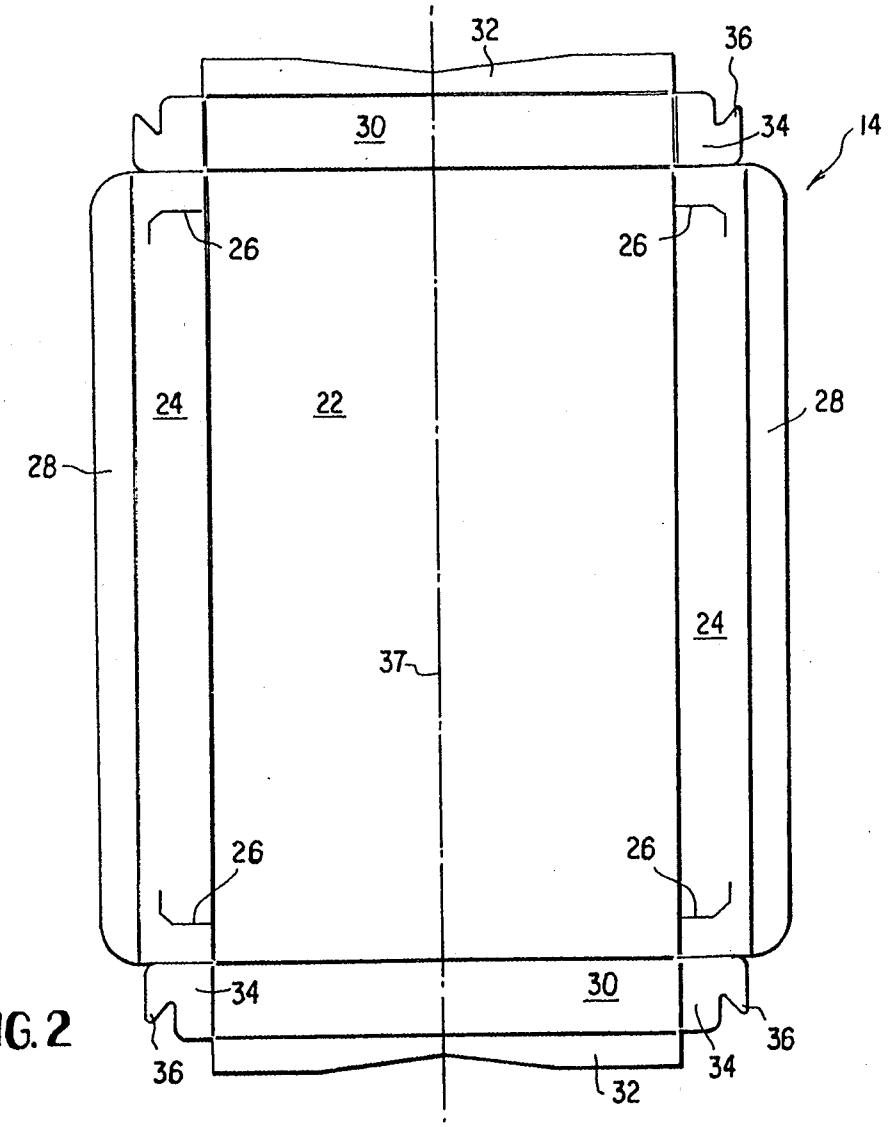
FIG. 2 is a plan view of a unitary paperboard blank from which the lower tray of FIG. 1 is formed.

Referring now to FIG. 2 of the drawings, a blank for forming bottom tray 14 is illustrated. The blank includes a bottom wall forming panel 22, longitudinally extending side panels 24, latching slits 26 at opposite ends of the side panels, and side ledge or flange forming panels 28. The ends of the blank include end panels 30 and ledge or flange forming panels 32. Each horizontal end of end wall forming panels 30 is provided with a tab 34 having a tongue 36 therein. The several panels are separated from each other and are defined by the indicated double lines, these denoting fold or bend lines to permit bending or folding of the panels relative to each other. The single lines shown at FIG. 2 indicate cut lines which extend completely through the thickness of the paperboard. The blank 14 is mirror symmetrical about axis 37. This blank may also be coated with a polymer such as PET (polyethylene terephalate) for heat resistance when used in a conventional oven.

Figure 3:
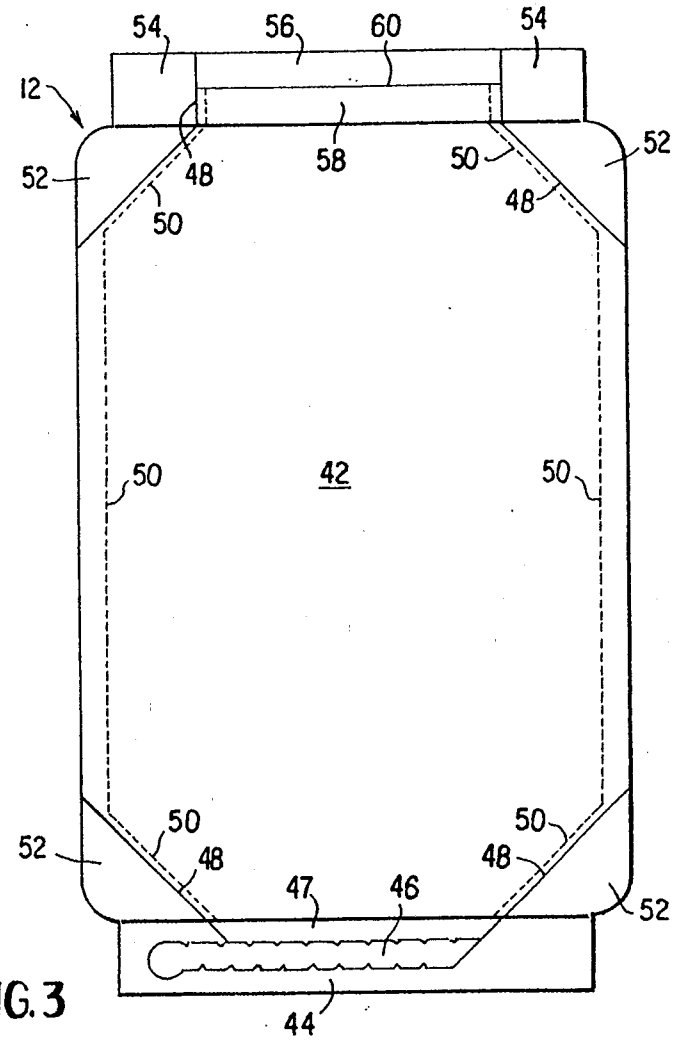
FIG. 3 is a plan view of a paperboard blank from which the top cover of FIG. 1 is formed.

Referring now to FIG. 3, the blank for forming top cover 12 includes a central main cover panel 42 having at its lower end a sealing panel 44. Panel 44, in turn, is provided with a tear strip 46 defined by parallel jagged cut lines which may of conventional construction. Cut lines 48, which slant at approximately 45 degrees as illustrated, extend halfway through the paperboard blank from the top down, i.e., extending in a direction away from the reader, and define a triangle 52 at each corner. Cut lines 50, shown as dashed in FIGS. 1, 3, and 4, extend along the longitudinal edges of the blank and also extend parallel to slanting cut lines 48. Cut lines 50 extend approximately halfway through the paperboard and extend from the bottom surface of the blank towards the reader. Panels 54 are located at the horizontal ends of panels 56 and 58 which are separated by a fold line 60, shown here as a line of single thickness. Cut lines 48, at the bottom of FIG. 3, extend to the top jagged line of tear strip 46. Cut lines 48 and 50, at the top of FIG. 3, extend to fold line 60.

Figure 4:
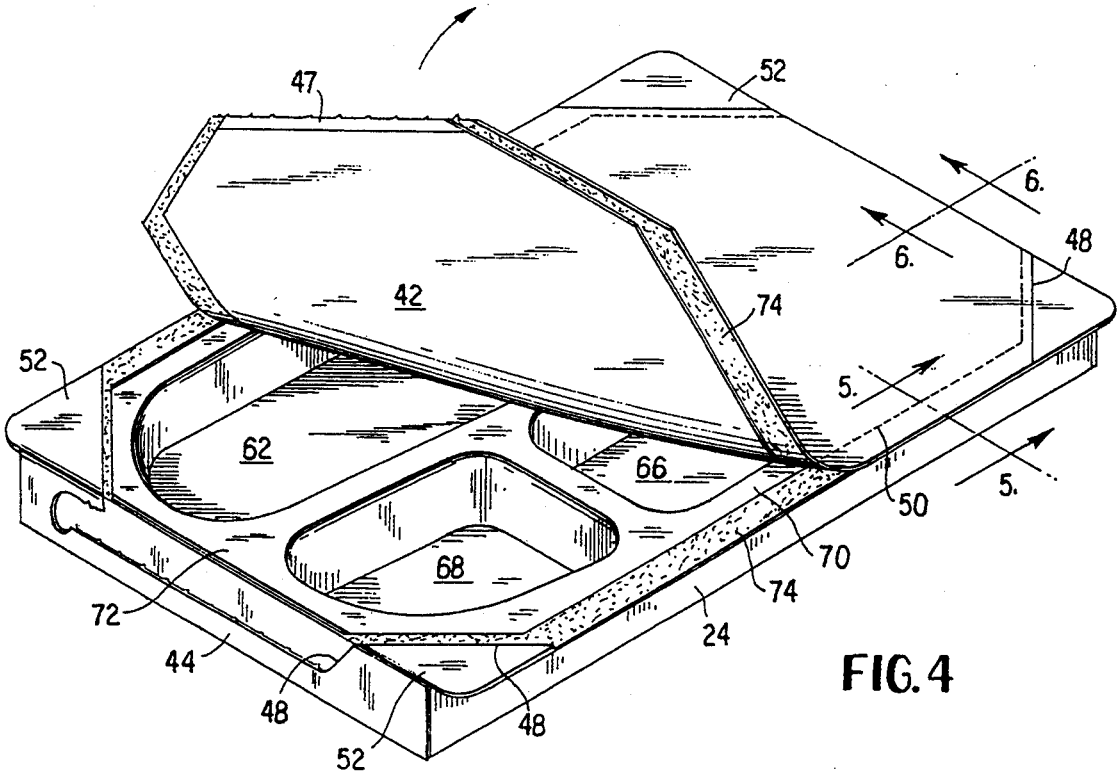
FIG. 4 illustrates the three elements of FIG. 1 in the assembled condition, and after tearing or ripping off of the top cover has been initiated.

FIG. 4 illustrates the opening action. Compartments 62, 64, 66, and 68 are filled with respective foodstuffs, not illustrated, such as an entree, vegetables and a dessert. The three elements of FIG. 1 are then assembled as indicated at FIG. 4 and the entire package refrigerated or frozen for shipment and storage. After retail purchase and just prior to cooking or heating, the user grasps the end of tear strip 46, ripping it away from panel 44 to permit the user to grasp portion 47 of panel 44 and pull the top cover 42 upwardly and away as shown by the curved arrow in FIG. 4. By virtue of the half thickness, parallel cuts 48 and 50, termed "reverse cuts" in the trade, the paperboard between these cuts tears or separates in the middle, as denoted by 74 at FIG. 5. The surfaces of these separated paperboard areas are also indicated 74 in FIG. 4. Continued tearing removes the entire top cover. The tearing and separating action is similar to that shown at FIG. 5 of U.S. Pat. No. 3,286,909 issued to Scharre. The plastic tray is retained within bottom tray 14 by triangular areas 52 at each of the four corners and by an overlap of torn paperboard from the longitudinal edges of the top cover. This is readily visualized at FIG. 5 wherein main cover portion 42 and those edges thereof above 74 have been removed upon opening the package, leaving the paperboard below 74.

For recycling disposal, the plastic tray is easily removed from the bottom paperboard tray, recalling that the plastic tray, after removal of the top cover, is not glued or otherwise bonded to the bottom tray or to the top cover.

Figure 5:
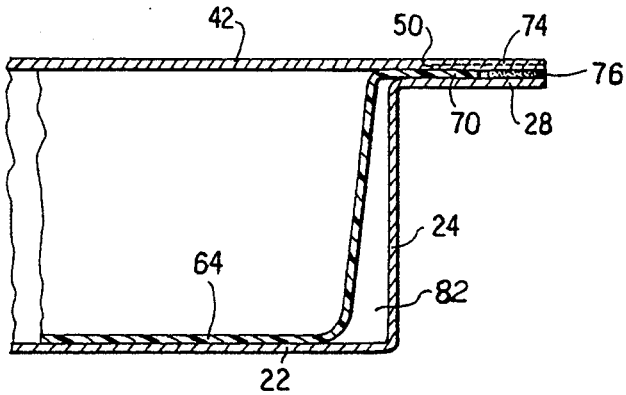
FIG. 5 is a view taken along section 5—5 of FIG. 4.

Referring now to FIG. 5, the right edge 70 of plastic tray 16 is seen as sandwiched between flange 28 of tray 14 and the right edge of top cover 42. The left flange is similarly sandwiched. An adhesive 76, placed on top of the laterally outermost regions of flanges 28, secures flanges 28 to corresponding longitudinal edge regions of top cover 12. FIG. 5 shows that the width of adhesive 76 is about one half of the distance from the long edges of cover 12 to cuts 50. There is a space between the adhesive or bonded area and the tray longitudinal edges.

Figure 6:
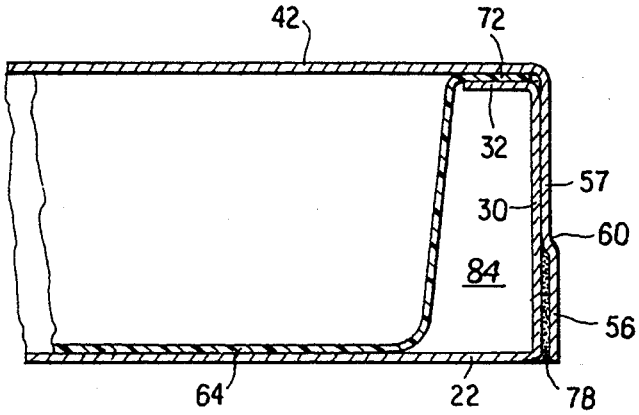
FIG. 6 is a view taken along section 6—6 of FIG. 4.

FIG. 6 illustrates that the end edges 72 of plastic tray 16 are clamped between flanges 32 of bottom tray 14 and the ends of top cover panel 42. The plastic tray is thus fixed to the other elements of the container solely by clamping the tray periphery. No adhesive or other bonding agent is required to secure the plastic tray flanges to the flanges of the bottom tray or to the cover lower periphery. Adhesive 76 may be omitted and the seal or connection between the lower peripheral surface of top cover 42 and lower tray flange 28 made by thermoplastic fusion of the thermoplastic coating on the lower tray with that of the top cover. The plastic tray flange 70 would not be sealed to either member 42 or 28 during thermoplastic fusion, accompanying conduction heating for example, because of dissimilar polymeric materials. Namely, the plastic coating composition for the paperboard members is preferably different from that of the plastic tray 16. If the plastic is the same (such as PET) for all three members, then different molecular weight or different crystalline structure plastics are employed for the plastic tray.

The bottoms of plastic tray depressions 62, 65, 66, 68 rest on bottom panel 22 of tray 14, as shown at FIGS. 5 and 6. Thus the weight of the foodstuffs in the several depressions or compartments of the plastic tray is supported by bottom panel 22. The longitudinal edges 70 and end edges 72 of the plastic tray are clamped, as described above, and are not subject to any foodstuff weight load. Such clamping fixes the plastic tray with respect to the lower tray and top cover. The plastic tray, by virtue of this construction, may be fashioned of relatively thin plastic, thus effecting cost savings. Typically the plastic tray is formed of C-PET for high temperatures up to 450 degrees F. or polypropylene for microwave applications. C-PET is the trade designation for a type of thermoformed PET which withstands elevated oven temperatures without distorting or warping. The lower paperboard tray 14 is effectively an integral part of the plastic tray 16 during transportation, handling, cooking, and consumption. Because of the thinness of the walls and flanges of the plastic tray, trays 14 and 16 must be coupled to each other in order to function. This is distinction to relatively thick conventional plastic trays which have the strength to function without the support of a lower paperboard tray or carton during transportation, handling, cooking, and consumption. Conventional plastic food trays of this type range between 0.025 and 0.030 inches in thickness. Tray 16 of this invention may be made in the range of 0.015 to 0.020 inches thick. This lightweighing reduces cost and is an environmental source reduction for recycling and landfill.

As seen at FIGS. 5 and 6, there is an air space 82 between the sides of the tray packages and the sides of the bottom tray, and an air space 84 at each end of the package between the plastic tray compartment and the end wall. This effectively provides insulation to inhibit burning the fingers of the user when the package is removed from an oven.

In those instances where a secondary cover or membrane is placed over the food filled plastic tray compartment prior to plastic tray insertion into the lower tray, the user would open the paperboard lid as shown at FIG. 4, and then cut away the flexible membrane.

Figure 7:
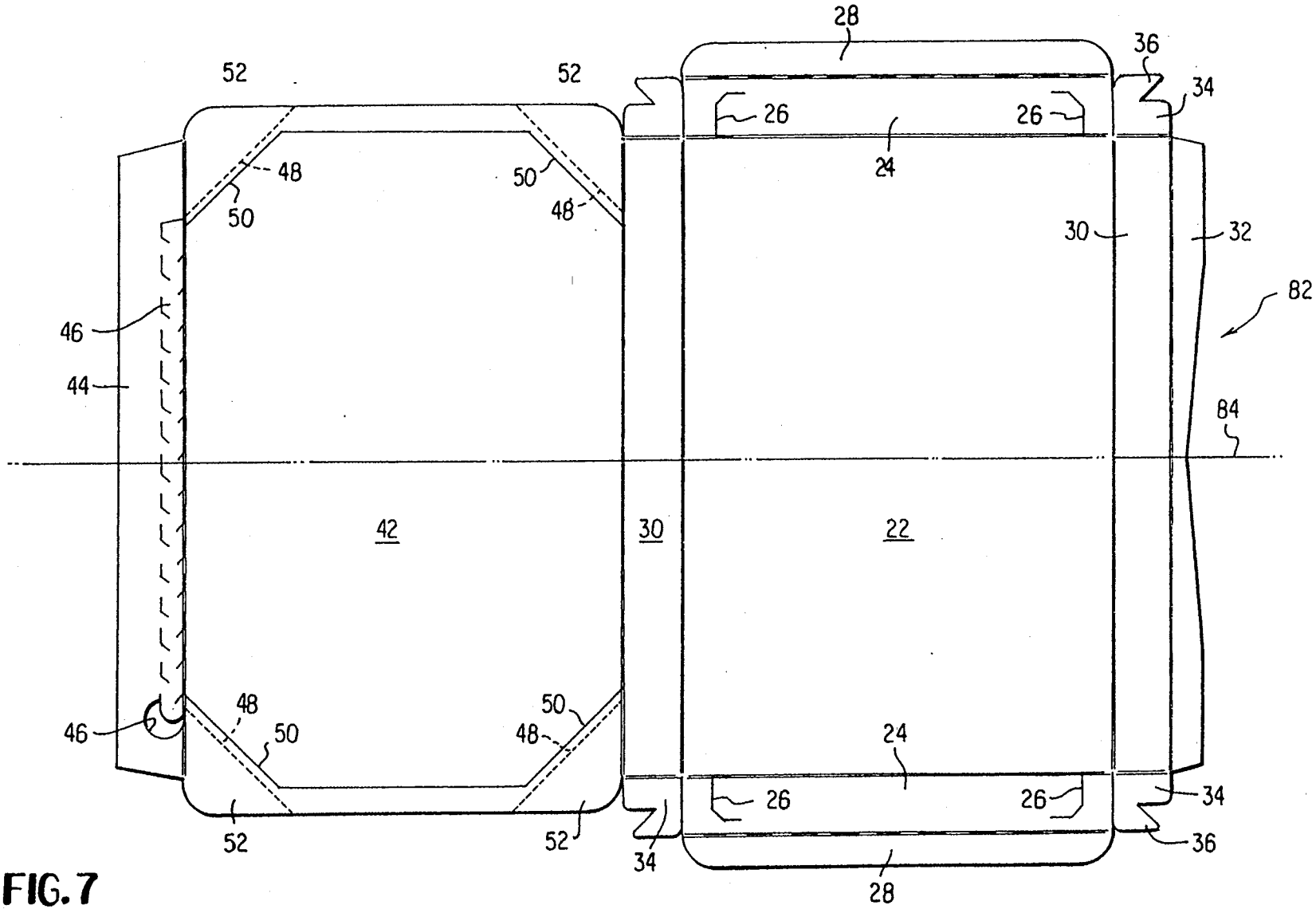
FIG. 7 is a view illustrating a unitary paperboard blank for forming an integral lower tray and top blank.
Figure 8:
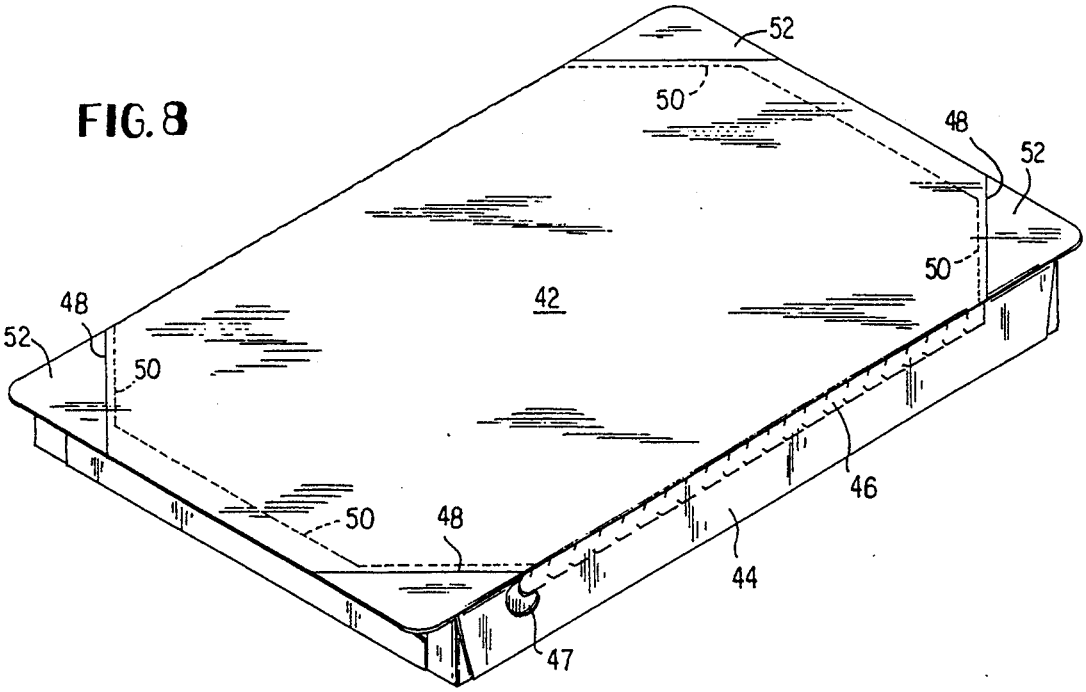
FIG. 8 is a perspective view of a container formed from the blank of FIG. 7.
Figure 9:
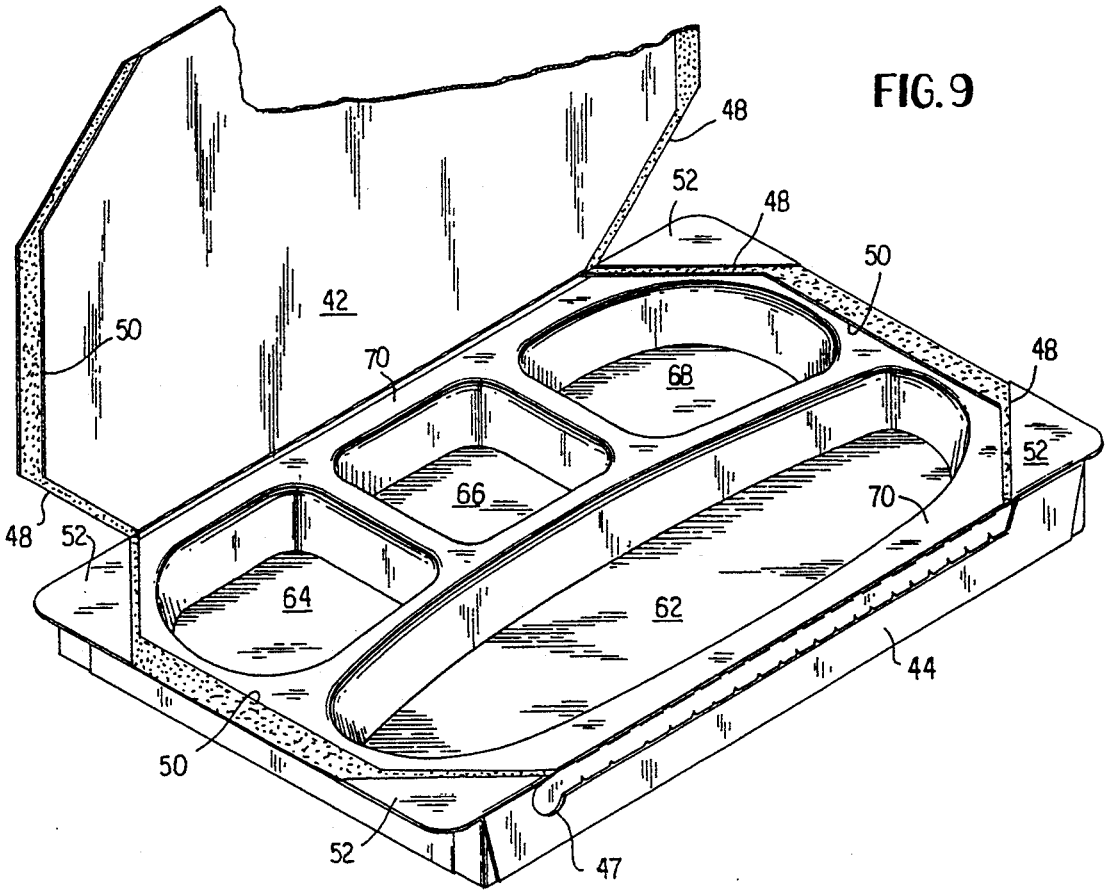
FIG. 9 is a perspective view of the container of FIG. 8 after opening.

Referring now to FIGS. 7–9, a modification of the invention is shown wherein the container which surrounds the plastic tray is formed from a unitary blank of paperboard or a similar material. The blank as shown at FIG. 7 is denoted generally as 82 and includes a mid-horizontal axis 84 dividing the blank into upper and lower portions. Similar reference numerals have been employed to designate corresponding or counterpart elements and thereby illustrate the description. Essentially, the blanks of FIGS. 2 and 3 have been combined into a single blank, so that the top cover 52 is integrally secured along a fold line to the left edge (viewing FIG. 7) of lefthand panel 30 of tray bottom 22.

FIG. 8 shows the container of this embodiment after the blank 82 has been folded and glued. Again, score lines 48 and 50, each passing about one halfway through the thickness of the paperboard, define so called reverse cuts.

FIG. 9 shows the container of FIG. 8 after it has been opened by pulling along tear or rip strip 46 by first grasping the free end thereof which extends into opening 47 in sealing panel 44. Ripping of strip 46 permits top cover panel 42 to be swung upwardly to thereby expose the plastic tray and its contents. A comparison between FIGS. 4 and 9 shows essentially the same opening action, the main reverse cuts differing in orientation by 90 degrees. The clamping action on the plastic tray flanges is the same in these two embodiments. The plastic tray 16 in FIGS. 4 and 9 is top loaded into bottom tray 14 at the time of package manufacture.

Figure 10:
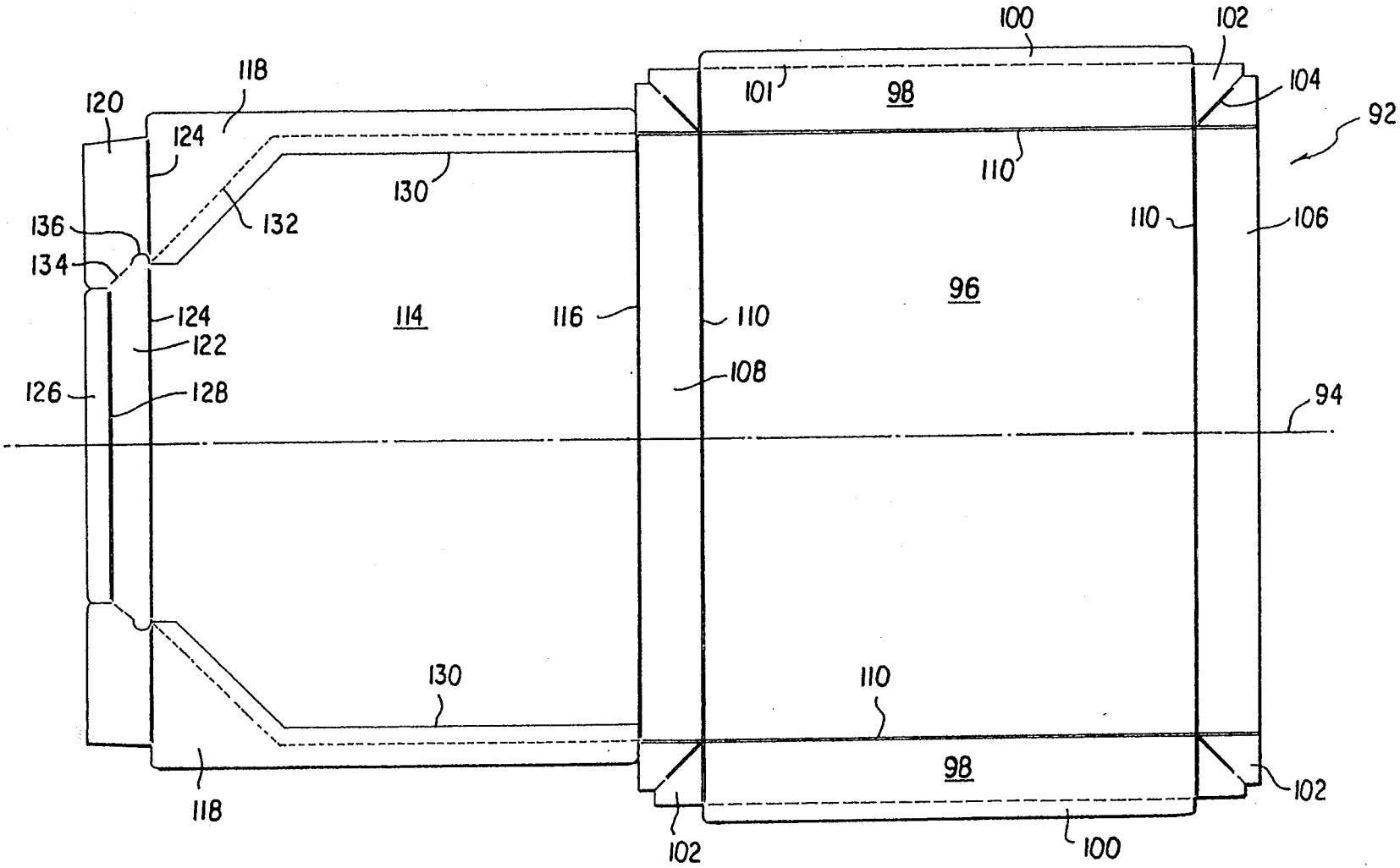
FIG. 10 is a plan view of a unitary paperboard blank of forming a tray holding outer sleeve.

Referring now to FIGS. 10–15, yet another embodiment of the invention is illustrated. Referring to FIG. 10, a unitary blank of paperboard, typically coated on both of its surfaces with a thin plastic film such as PET is, designated as 92. The blank includes a bottom forming panel 96 having upper and lower panels 98 hingedly secured thereto. The upper and lowermost edges of respective upper and lower panels 98 are provided with flange or flap portions 100 defined by fold lines 101. Each corner of panel 96 includes gussets 102, notched as illustrated, and each having a 45 degree slant line 104. The right hand portion of panel 96 is provided with panel 106, while the left hand portion is provided with panel 108. Fold lines 110 border panel 96. It will be seen that blank 92 exhibits mirror symmetry about a horizontal axis 94.

The left portion of panel 108 is secured to top forming panel 114 by fold line 116. Upper and lower portions of panel 114 include triangular sections of zones 118 at upper and lower regions thereof. A single flap foldably secured to the left edge of panel 114 is comprised or portions 120, 122, and 126. Fold line 124 couples portions 120, and portions 122, 126 to panel 114. Fold line 128 separates panel portions 122 from portion 126. Cut 134, extending half way through the paperboard, is similar to cut 132, with these two cut lines coupled by respective arcuate cuts 136 both above and below axis 94.

Figure 11:
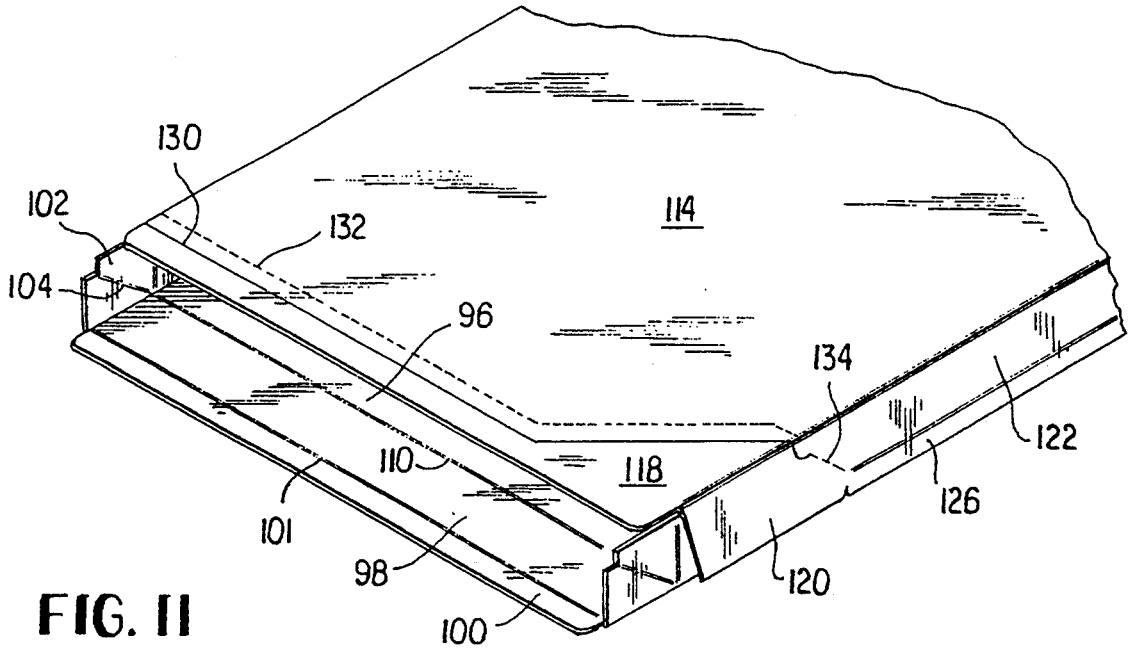
FIG. 11 illustrates the sleeve of FIG. 10 folded and glued to form a sleeve prior to the insertion of the plastic tray therein.

Referring now to FIG. 11, the blank of FIG. 10 has been folded and glued, with panel 122 being glued to the outside of panel 106. Panel 126 is not glued to panel 106 to thereby permit opening of the package, as will shortly be described. One end of the resultant rectangular sleeve structure is illustrated at FIG. 11, the sleeve being initially open at both ends, it being understood that the other end is of identical construction. Plastic tray 16, filled with food products is now inserted into either end of the sleeve of FIG. 11. This differs from the previous embodiments in that the thin plastic tray is end loaded in the sleeve or carton. After such insertion, both panels 98 are folded upwardly, with panel 100 bending about fold line 101 to thereby close both ends of the rectangular sleeve. The package is now ready for freezing or refrigeration of the foodstuffs.

Figure 12:
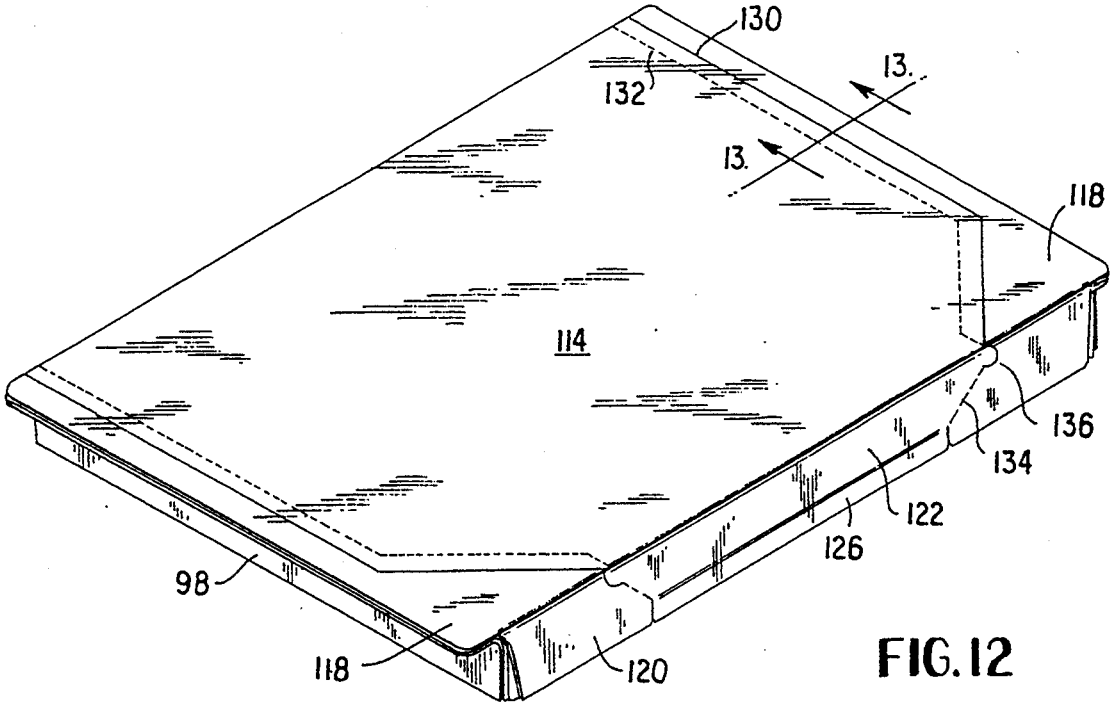
FIG. 12 is a perspective view showing the completed package formed from the blank of FIG. 10 and the plastic tray.

The completely sealed package is shown at FIG. 12, the package being ready for opening by the user.

Figure 13:
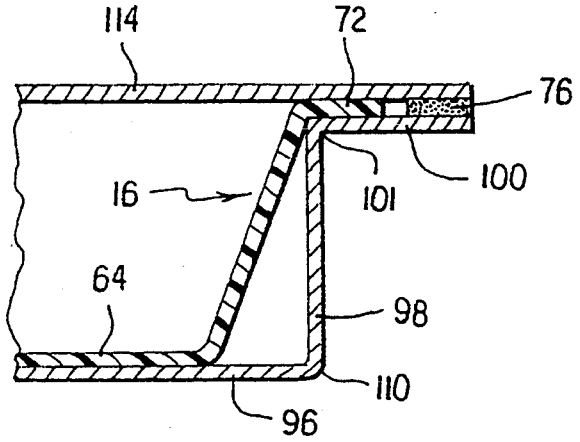
FIG. 13 is a view taken along section 13—13 of FIG. 12.

Referring now to FIG. 13, it seen that end flanges 72 of plastic tray 16 are clamped between the lower surface of top cover 114 and panel or flap 100. FIG. 13 is similar to FIG. 5 in showing adhesive 76 joining flap 100 to the top cover 114, or alternatively, 76 may represent a thermoplastic fusion between these elements derived from partial melting of a thin plastic coating on the paperboard. The side flanges 70 of plastic tray 16 (see FIG. 1) are not clamped or glued to any member.

Figure 15:
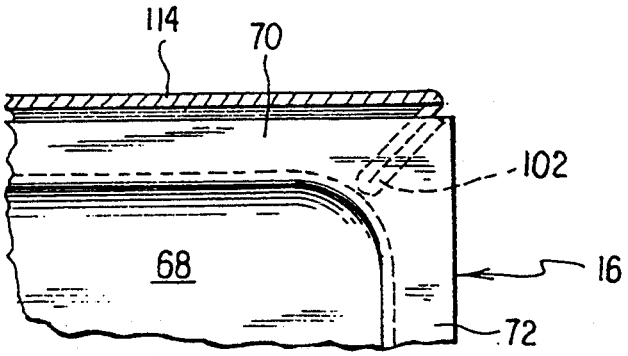
FIG. 15 is a view taken along section 15—15 of FIG. 14.

Referring again to FIG. 11, it is readily visualized that inward folding of gussets 102 about respective fold lines 104 and the inward folding of panel 98 about fold line 110 results in gussets 102 being positioned interiorly of the container, so as to resiliently urge (due to the resiliency of paperboard) opposite longitudinal sides of the plastic tray towards the center of the container. This is shown at FIG. 15. Further, flanges at the corners of plastic tray 16 will contact and rest on folded gussets 102.

Figure 14:
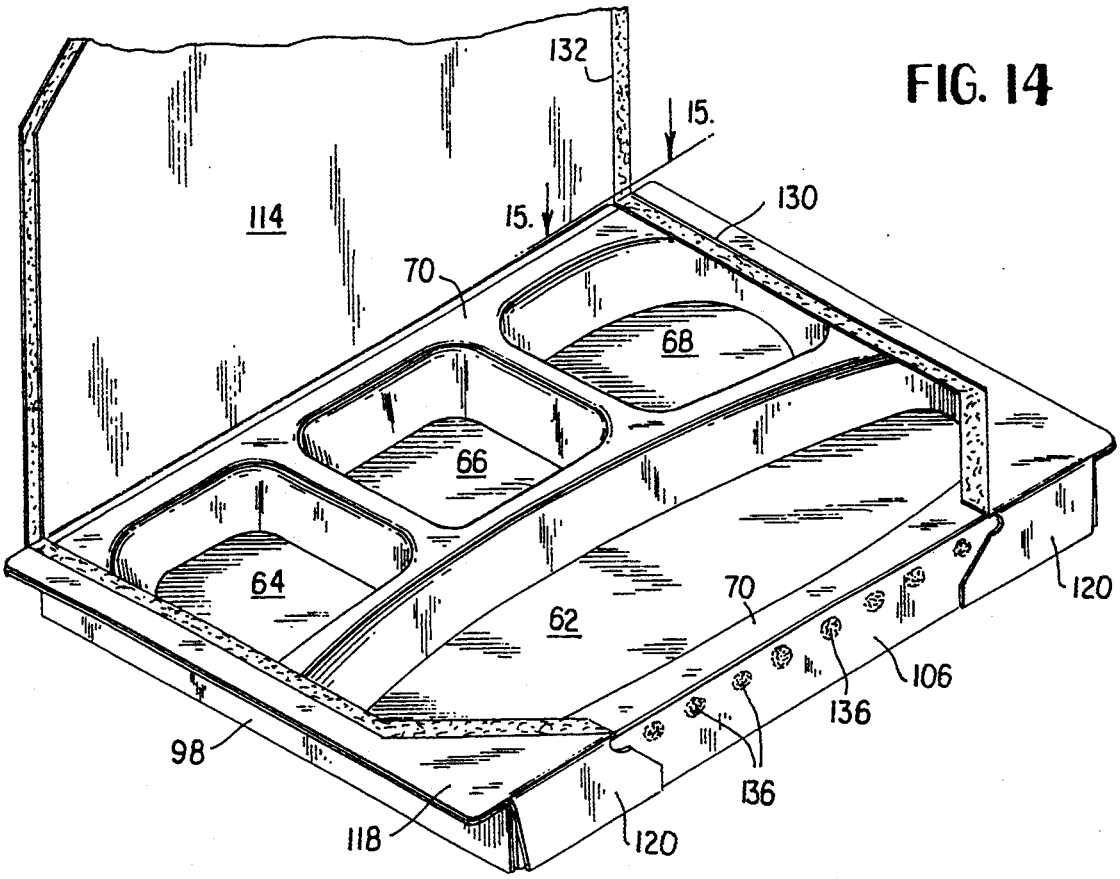
FIG. 14 is a view similar to FIG. 12 and shows the package after opening.

To open the package to the configuration of FIG. 14, the user grasps flap 126 and pulls upwardly, thus forcibly releasing flap 122 from glue spots 136.

Food packages of the types described above are typically at least six inches in length at least four inches in width.

Geometrical terms of orientation, such as horizontal, are employed to facilitate the description and are not intended as terms of limitation.

We claim:

1. A foodstuff container for the packaging of refrigerated or frozen foodstuffs, the container including a generally horizontal rectangular parallelepiped lower tray having ends and fashioned from a unitary blank of paperboard, said lower tray having a bottom wall and two opposite longitudinal side walls and two opposite end walls, said lower tray having horizontally extending flanges along its said side walls, a horizontal plastic tray of generally rectangular outline and having compartments, a horizontal top cover of generally rectangular outline, edges of said plastic tray resting on portions of said horizontal flanges said lower tray, other portions of said flanges of said lower tray glued to respective edges of said top cover, whereby said edges of said plastic tray are clamped by and sandwiched between portions of said lower tray flanges and edge portions of said top cover, said plastic tray compartments resting on said bottom wall of said lower tray, whereby after opening said container and consuming any foodstuffs in said compartments said plastic tray can be removed from said lower tray for recycling without carrying any adhesive or paperboard with it.

2. The foodstuff container of claim 1 wherein said top cover is provided with a tear strip and tear lines to thereby permit a major portion of the top cover to be removed to thereby obtain access to the compartments in the plastic tray.

3. The foodstuff container of claim 1 wherein said longitudinal edges of said lower tray extend horizontally laterally outwardly.

4. The foodstuff container of claim 1 wherein said ends of said lower tray are provided with horizontal flanges which extend inwardly of said tray.

5. A foodstuff container for the packaging of refrigerated or frozen foodstuffs, the container including a generally horizontal, rectangular parallelepiped lower tray fashioned from paperboard, said lower tray having a bottom wall and two opposite longitudinal side walls and two opposite end walls, said lower tray having horizontally extending flanges along at least two opposite of said side walls, a horizontal plastic tray having side walls and being of generally rectangular outline and having two opposite horizontal flanges, said flanges of said plastic tray resting on portions of said flanges of said lower tray, at least some remaining portions of said plastic tray resting on the bottom of said lower tray, a top cover paperboard panel on said lower tray, said top cover having a periphery, a portion of said top cover perphery adhered to said flanges of said lower paperboard tray to thereby clamp said flanges of said plastic tray between said flanges of said lower tray and said top cover periphery, whereby said plastic tray can be easily removed from said container.

* * * * *